US005832711A

United States Patent [19]

Baumgartner

[11] Patent Number: 5,832,711

[45] Date of Patent: Nov. 10, 1998

[54] OPEN-END SPINNING ROTOR

[75] Inventor: Helmut Baumgartner, Ingolstadt, Germany

[73] Assignee: Rieter Ingolstadt Spinnereimaschinenbau AG, Ingolstadt, Germany

[21] Appl. No.: 841,159

[22] Filed: Apr. 29, 1997

[30] Foreign Application Priority Data

May 4, 1996 [DE] Germany ..... 196 18 027.9
May 18, 1996 [DE] Germany ..... 196 20 121.7

[51] Int. Cl.[6] ..... D01H 4/00

[52] U.S. Cl. ..... 57/404; 57/406

[58] Field of Search ..... 57/404, 407, 408, 57/411, 412, 413, 414, 415, 417

[56] References Cited

U.S. PATENT DOCUMENTS

| | | | |
|---|---|---|---|
| 4,319,449 | 3/1982 | Hofmann | 57/404 |
| 4,503,663 | 3/1985 | Oexler | 57/404 |
| 5,526,638 | 6/1996 | Bock et al. | 57/404 |
| 5,555,715 | 9/1996 | Paweletz et al. | 57/414 |
| 5,634,326 | 6/1997 | Wanger | 57/406 |
| 5,644,910 | 7/1997 | Ball et al. | 57/414 |

FOREIGN PATENT DOCUMENTS

| | | | |
|---|---|---|---|
| 620298 | 10/1994 | European Pat. Off. | 57/414 |
| 3815182 | 11/1989 | Germany | 57/414 |
| 3815182A1 | 11/1989 | Germany . | |
| 4009374 | 9/1991 | Germany . | |
| 4020518 | 1/1992 | Germany . | |
| 9319151.0 | 4/1994 | Germany . | |
| 4342539A1 | 6/1995 | Germany . | |

OTHER PUBLICATIONS

German Search Report, Aug. 1, 1996.

*Primary Examiner*—William Stryjewski
*Attorney, Agent, or Firm*—Dority & Manning

[57] ABSTRACT

For the improvement of open-end spinning rotor, whereby the spinning rotor is connected to its shaft via a coupling, the coupling (2) is made as a separate component. The coupling is provided with a first seat (21) for the rotor pot (11) and with a second seat (22) for the supporting element (12). Provisions are also made for the coupling to be provided with a locking element (25) which is conical and which locks the rotor pot (11) together with its supporting element (12) as a result of the centrifugal force during operation of the spinning rotor.

11 Claims, 2 Drawing Sheets

OPEN-END SPINNING ROTOR

BACKGROUND OF THE INVENTION

The present application relates to an open-end spinning rotor. A spinning rotor whose rotor pot is connected to the rotor shaft via a coupling arrangement is known from DE A 38 15 182. The coupling arrangement is formed either on the rotor pot or on the rotor shaft. In an embodiment in which the coupling arrangement is attached to the rotor shaft, it consists of two elastic hooks which engage an undercut on the rotor pot when the rotor pot and rotor shaft are joined together. This undercut is in the form of an inclined surface. During operation of the spinning rotor, the hooks press on this inclined surface as a result of centrifugal force causing the pot of the spinning rotor to be pulled in the direction of the rotor shaft, so that the connection between rotor pot and rotor shaft is intensive and secure even during operation of the spinning rotor. In another embodiment, the coupling arrangement is attached to the rotor plate. The disadvantage of the known spinning rotors is that the coupling arrangement is attached either to the rotor pot or to the rotor shaft, so that the costs of these components is increased considerably on the one hand, while on the other hand the production of the coupling on the corresponding component is costly.

An open-end spinning rotor in which the rotor pot is attached to the basic body supporting and driving it by means of a type of screw connection is known from DE-A 43 42 539. In this embodiment the additional danger exists that the rotor pot may become detached during acceleration or deceleration processes.

OBJECTS AND SUMMARY OF THE INVENTION

It is a principal object of the present application to avoid the disadvantages of the state of the art and to propose an open-end spinning device with a spinning rotor which is simpler in construction and costs less to manufacture. Additional objects and advantages of the invention will be set forth in part in the following description, or may obvious from the description, or may be learned through practice of the invention.

Thanks to the design of an open-end spinning rotor according to the invention, the supporting part as well as the rotor pot can be of simple configuration so that they can be produced at low cost, as is especially necessary since the rotor pot, as well as in part supporting elements, are wear or replacement parts. The coupling itself is subject to practically no wear and can be used again and again. It can therefore also be low in cost and can be manufactured in an especially simple manner, because it is not made in one piece with a rotor pot or with a supporting element. Furthermore, the separate design of the coupling offers many more possibilities in its configuration. The design of the coupling is especially advantageous if it is provided with locking elements which become active due to the centrifugal force as the spinning rotor is in operation. In this manner, a secure locking connection between coupling and spinning rotor which is also particularly secure and reliable during operation of the spinning rotor is achieved. At the same time, this facilitates the removal of the rotor pot from the supporting element during stoppage, because the locking elements can be unlocked much more easily in the absence of the centrifugal force.

It is especially advantageous to design the locking elements spherical or, even more advantageously, directly as a ball, since in that case particularly inexpensive material parts can be used as locking elements so that the coupling can be produced at low cost. Furthermore, spherical locking elements have the advantage that they offer advantageous geometrical conditions for the interaction with the surfaces on supporting element or rotor pot which interact with them. In addition, it is advantageous to design at least one seat of the coupling in the form of a screw head which interacts interlockingly with the rotor pot. Thereby secure attachment of the rotor pot to the coupling is achieved.

It is especially advantageous for the rotor pot to be provided with a central bore through which the coupling is inserted, so that it pulls the rotor bottom with its screw-head shaped part against the supporting element. It is especially advantageous for the locking body to interact with the inclined surfaces if these are inclined in such a manner that pressing the locking body against them produces and axial force component as a result of the centrifugal force, so that the rotor pot and the supporting element are pressed against each other. It is furthermore advantageous for the first seat of the coupling which receives the rotor pot, as well as the second seat which receives the supporting element, to be made with locking elements. It is especially advantageous then to make both opposing surfaces, the one on the rotor pot as well as the one on the supporting element, in the form of surfaces inclined against the rotational axis of the rotor pot, and this in such a manner that a force component through the locking elements on these surfaces causes the rotor pot and the supporting element to be pressed against each other. Especially when high rotational speeds are used, a secure connection between the two parts is thereby achieved. In an advantageous embodiment of the coupling, the latter is provided with a handle or an extension for a tool, e.g. a coupling point to attach a pull-off device, so that the coupling can be taken out easily in order to take the spinning rotor apart into its components, or to separate the coupling from the rotor pot. Thereby, disassembly of the coupling and with it also of the rotor pot can be achieved advantageously, and this without any load being created on the supporting element. As an example, a pull-off device may bear on the rotor pot as the coupling is taken out. This is especially advantageous in open-end spinning devices where the supporting element cannot be easily taken out of the bearing of the spinning rotor, e.g. in bearings where the shaft of the spinning rotor is supported by means of ball bearings. In an especially advantageous further development of the invention, the coupling combines the rotor pot and the supporting element in such a manner that at the same time an interlocking connection between coupling and rotor pot and supporting element is produced. This advantageously ensures that no relative movement between supporting element and rotor pot will occur in the circumferential direction. This is especially important during the acceleration of the spinning rotor and when it is braked until it stops. The interlocking connection is established via the coupling, and for this reason the latter is connected interlockingly with the rotor pot as well as with the supporting element in the circumferential direction of the spinning rotor. In another embodiment of the spinning rotor, and to achieve the same goal, the rotor pot is designed in such a manner relative to the supporting element in the circumferential direction so that the two cannot rotate relative to each other.

The invention is explained below through drawings.

DETAILED DESCRIPTION OF THE PREFERRED EMBODIMENTS

Figure 1:
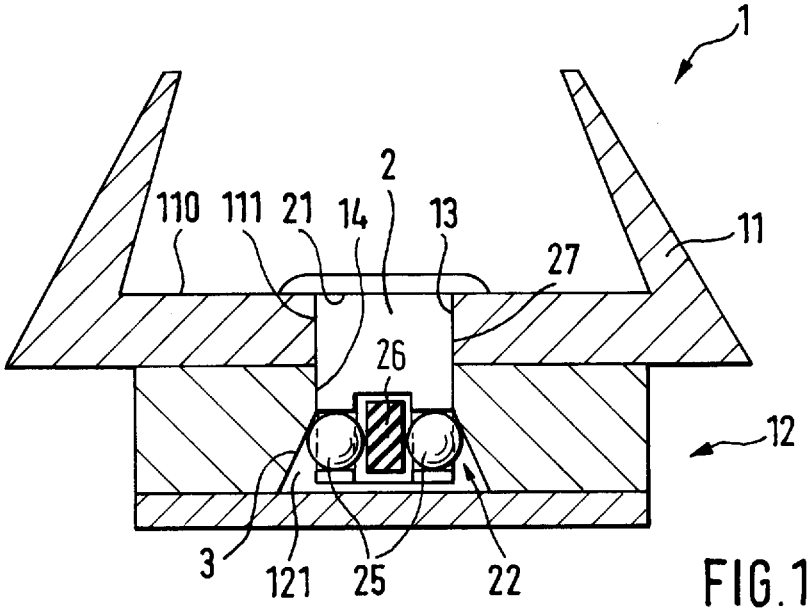
FIG. 1 shows an open-end spinning rotor according to the invention on a supporting element mounted without shaft.

Reference will now be made in detail to one or more presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present invention cover such modifications and variations as come within the scope and spirit of the invention.

FIG. 1 shows an open-end spinning rotor 1 consisting of a rotor pot 11, a supporting element 12, and a coupling 2. Coupling 2 is inserted for this through a bore 111 of the rotor pot 11 as far as into the supporting element 12. With its first seat 21 which is designed similar to a screw head, the coupling bears upon the bottom 110 of the rotor pot 11. The second seat 22 of the coupling 2 holds the supporting element 12 via two locking elements 25 made in the form of balls. During stoppage of the spinning rotor, the locking elements 25 are pushed to the outside via the elastic element 26 as viewed relative to the rotational axis of the spinning rotor, so that they are pressed against the inclined surfaces 3 of the supporting element 12. The inclined surface 3 is the sleeve surface of a conically widened bore 121 of the supporting element 12. The elastic element 26 is in the form of a rubber block which is located between the locking elements 25. In the assembled state shown in FIG. 1, the elastic element 26 is under pressure and presses the locking elements 25 to the outside on the inclined surface 3, causing the coupling 2 to pull the rotor pot 11 via the first seat 21 in the direction of the supporting element 12. To disassemble the rotor pot 11 from the supporting element 12, the coupling together with the rotor pot 11 are pulled off the supporting element 12. At the same time the locking elements 25 are pressed by the elastic element 26 to the inside and the coupling is pulled out of the bore 121 of the supporting element 12. To separate the coupling from the rotor pot it then merely needs to be pressed through the bore 111 in the rotor pot 11. During the operation of the openend spinning rotor 1 the latter is caused to rotate, so that the locking elements 25 are pressed radially towards the outside, against the inclined surface 3 as a result of the centrifugal force and establish a secure locking connection between the rotor pot and the supporting element. To center the rotor pot on the supporting element, the rotor pot 11 is provided with a centering surface 13 which corresponds to the side of bore 111. The supporting element 12 is also provided with a centering surface 14 which corresponds to the side of the bore 121 in its cylindrical section. For this, the centering surfaces 13 and 14 interact with the centering surface 27 of the coupling 2. The centering surface 27 of the coupling 2 corresponds to its cylindrical sleeve surface. The supporting element 12 of the open-end spinning rotor 1 of FIG. 1 consists of several parts. In particular the part of supporting element 12 away from the rotor pot 11 serves to support the open-end spinning rotor 1 in a known manner and to drive it.

Figure 2:
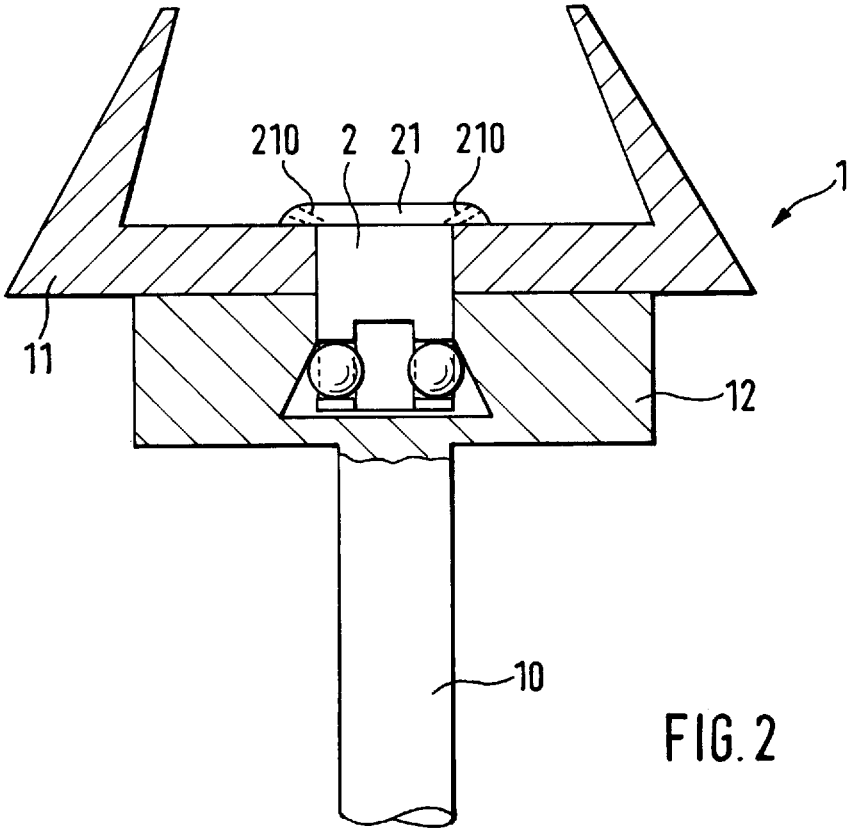
FIG. 2 shows an open-end spinning rotor with a supporting element showing a shaft for the support of the spinning rotor in a bearing.

FIG. 2 shows a spinning rotor 1 which is supported by means of a shaft 10. The support can be in a known manner by means of supporting disks which may be arranged in two pairs for example, or also by means of direct support of the shaft 10 via roller bearings or air bearings. The support of the spinning rotor is not important as far as the present invention is concerned. The shaft 10 of the open-end spinning rotor 1 of FIG. 2 merges into the supporting element 12, the configuration of which is as that of the supporting element of FIG. 1. The seat 21 of the coupling 2 is provided with two holes 210 into which two receiving mandrels of a pull-off device, not shown here, can be engaged in order to pull the coupling 2 out of the supporting element 12. The holes 210 constitute a coupling location of the pull-off device which bears during the pulling-out operation of the coupling upon the bottom of the rotor pot 11, so that the removal of the coupling is possible without a load being placed on the bearing of the spinning rotor, such as may be caused by pulling or pressing forces, for example.

Figure 3:
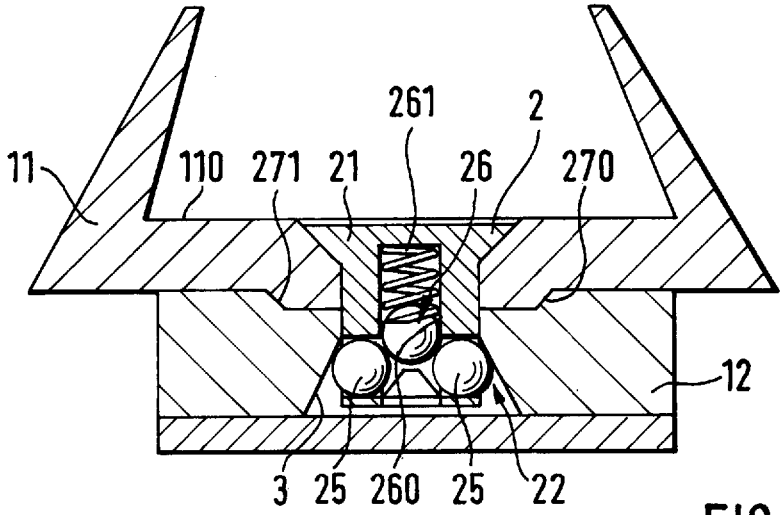
FIG. 3 shows an open-end spinning rotor with centering surfaces between rotor pot and supporting element and FIG. 4 shows a representation of a coupling with ball-shaped locking elements.

FIG. 3 shows a shaft-less spinning rotor similar to that of FIG. 1. The coupling 2 has a second seat 22 which is made with locking elements 25 as the one of FIG. 1 and interacts via an inclined surface 3 of the supporting element 12 with the latter. The first seat 21 is configured similarly to a screw head of a countersunk head screw. This has the advantage that the bottom 110 of the rotor pot 11 constitutes a flat surface which may be advantageous for the spinning operation of the open-end spinning rotor 1 under certain circumstances. The elastic element 26 here, contrary to the one of FIG. 1, consists of a spring-loaded ball 260 which is pressed by the spring 261 in direction of the locking elements 25, so that the latter are pressed against the inclined surface 3 even when the spinning rotor is stopped and ensure a locking connection between spinning rotor and rotor pot. The rotor pot is centered on the supporting element in FIG. 3 via a part of the conical sleeve surface 270 of the supporting element with which a corresponding centering surface 271 of the rotor pot 11 interacts.

Figure 4:
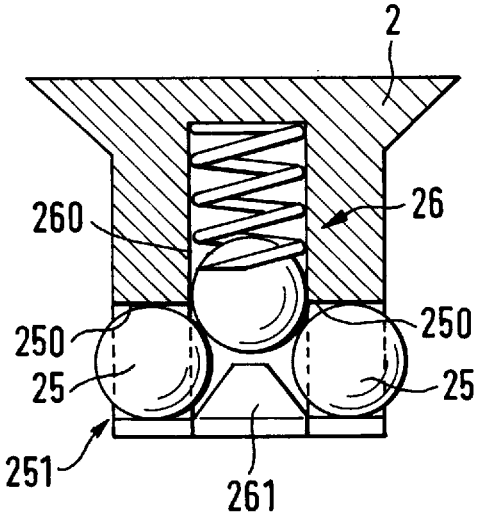

The coupling 2 of FIG. 3 is enlarged in FIG. 4. The locking elements 25 are going through transverse bores 250 and protrude through them radially from the coupling 2 as a result of the pressure of the elastic element 26. The diameter of the lower edge 251 of the transverse bores is reduced here so that the locking elements 25 cannot radially protrude completely from the coupling 2. This prevents the locking element from falling out of the coupling. The elastic element 26 is provided with an axial bore 260 which is closed at its open end by means of a closing element 261, so that neither the elastic element 26 nor the locking elements 25 may fall out of the coupling 2. The locking elements 25 in FIGS. 1 to 4 are made in the form of balls, but could just as well be made in the form of cylinders or similarly acting geometrical bodies. In order to act at the same time as an anti-rotation device between the rotor pot 11 and the supporting element 12, the coupling 2 may also be made in the form of a rotationally symmetrical part, e.g. with a square cross-section. The openings in the rotor pot and in the supporting element are then designed accordingly. The same effect can also be achieved by designing the contact surfaces between the rotor pot 11 and the supporting element 12 so that a rotational movement relative to each other is not possible. The supporting element could just as well be provided with one or several pins inserted in the axial direction (not shown) which engage the rotor top axially in order to prevent rotation.

It should be apparent to those skilled in the art that various modifications and variations can be made in the invention without departing from the scope and spirit of the invention. It is intended that the present invention cover such modifications and variations as come within the scope of the appending claims and their equivalents.

I claim:

1. An open-end spinning rotor, comprising:

a rotor pot having an open side and a bottom side with a bore therethrough;

a supporting element configured to receive said rotor pot;

a coupling element separate from said rotor pot and said supporting element, said coupling element extending through said open side and bore into said supporting element and connecting said rotor pot to said supporting element; and a centrifugal force actuated locking element integrated with said coupling element and configured to lock said rotor pot to said supporting element with centrifugal force generated during operation of said spinning rotor.

2. The open-end spinning rotor as in claim 1, wherein said locking element comprises at least one biased spherical body.

3. The open-end spinning rotor as in claim 1, wherein said locking element further comprises a biasing mechanism to bias said locking mechanism into a locking position during a stopped condition of said spinning rotor.

4. The open-end spinning rotor as in claim 1, wherein said supporting element comprises a bore defined at least in part by an inclined surface, said connecting element extending through said rotor pot and into said bore, said locking element comprising at least one spherical body carried by said connecting element and radially movable relative to a rotational axis of said spinning rotor against said inclined surface, said inclined surface angled relative to said rotational axis of said spinning rotor such that radially outward movement of said spherical body against said inclined surface draws said supporting element and said rotor pot together.

5. The open-end spinning device as in claim 4, wherein said locking element comprises at least two said spherical bodies.

6. The open-end spinning device as in claim 5, further comprising a biasing element disposed between said spherical bodies so as to bias said spherical bodies radially outward relative to said rotational axis of said spinning rotor.

7. The open-end spinning device as in claim 1, wherein said coupling element comprises a head attached to a cylindrical extending member.

8. The open-end spinning device as in claim 7, wherein said head is countersunk in said rotor pot.

9. The open-end spinning device as in claim 1, further comprising centering surfaces defined between said connecting element and said rotor pot and said supporting element for centering said rotor pot relative to said supporting element.

10. The open-end spinning device as in claim 1, wherein said connecting element further comprises a pull-off means integrated therewith for pulling said connecting element from said supporting element.

11. The open-end spinning device as in claim 1, further comprising circumferential interlocking surfaces defined on said rotor pot and said supporting element.

* * * * *